US007479250B1

(12) United States Patent
Areaux et al.

(10) Patent No.: US 7,479,250 B1
(45) Date of Patent: Jan. 20, 2009

(54) SEGMENTED WELL BLOCK

(75) Inventors: Larry Areaux, 1070 Matecumbe Key Rd., Punta Gorda, FL (US) 33955-4683; Erik Grimm, Canton, OH (US)

(73) Assignee: Larry Areaux, Punta Gorda, FL (US)

( * ) Notice: Subject to any disclaimer, the term of this patent is extended or adjusted under 35 U.S.C. 154(b) by 394 days.

(21) Appl. No.: 11/228,849

(22) Filed: Sep. 16, 2005

Related U.S. Application Data

(60) Provisional application No. 60/610,739, filed on Sep. 17, 2004.

(51) Int. Cl.
*C21C 5/42* (2006.01)
*C21B 7/16* (2006.01)

(52) U.S. Cl. ..... 266/236; 266/266

(58) Field of Classification Search ..... 266/236, 266/266

See application file for complete search history.

(56) References Cited

U.S. PATENT DOCUMENTS

| | | | | |
|---|---|---|---|---|
| 4,470,582 | A * | 9/1984 | Shaw et al. | 266/266 |
| 6,893,607 | B2 | 5/2005 | Areaux et al. | 266/217 |
| 2003/0047850 | A1 | 3/2003 | Areaux | 266/44 |
| 2003/0201588 | A1 * | 10/2003 | Peretz et al. | 266/286 |

* cited by examiner

*Primary Examiner*—Vickie Kim
*Assistant Examiner*—Caitlin Fogarty
(74) *Attorney, Agent, or Firm*—Renner, Kenner, Greive, Bobak, Taylor & Weber

(57) ABSTRACT

A well block for use within a circulation chamber of a molten metal furnace, comprising A first portion and a second portion, wherein said first portion is positioned atop said second portion, said first and second portions defining a cavity which includes an upper cylindrical surface defining a gradually decreasing diameter, a lower cylindrical surface having a diameter less than said upper cylindrical surface and a medial surface interposed between said upper and said lower cylindrical surfaces, and an outlet positioned proximate to said lower cylindrical surface, said cavity communicating with the circulation chamber via said outlet.

10 Claims, 13 Drawing Sheets

SEGMENTED WELL BLOCK

This application claims the benefit of U.S. Provisional Application No. 60/610,739, filed Sep. 17, 2004.

FIELD OF THE INVENTION

This invention relates to a segmented well block provided for use in a molten metal furnace.

BACKGROUND OF THE INVENTION

Well blocks are commonly used in molten metal furnaces to melt metal chips, and, thereafter, mix the melted metal chips with the molten metal within the furnace. Although well blocks have a useful lifetime, well blocks are exposed to extreme temperature differentials that may lead to cracking or fracturing thereof.

While these cracks have not caused failure of the blocks or the pumps with which they used, there is a desire to replace these cracked well blocks, which ultimately results in an inability to take advantage of the entire useful life of the block. Attempts have also been made to patch these cracks with ceramic caulks and the like, but these attempts have not proved useful.

A need therefore remains to prevent, alleviate, or effectively repair cracks that occur in well blocks.

SUMMARY OF THE INVENTION

In one or more embodiments, the present invention provides a well block for use within a circulation chamber of a molten metal furnace, comprising a first portion and a second portion, wherein said first portion is positioned atop said second portion, said first and second portions defining a cavity which includes an upper cylindrical surface defining a gradually decreasing diameter, a lower cylindrical surface having a diameter less than said upper cylindrical surface and a medial surface interposed between said upper and said lower cylindrical surfaces, and an outlet positioned proximate to said lower cylindrical surface, said cavity communicating with the circulation chamber via said outlet.

In one or more embodiments, the present invention further provides a segmented well block for use within a circulation chamber of a molten metal furnace comprising a first portion and a second portion, wherein said first portion is positioned atop said second portion, said first and second portions defining a cavity which includes an upper cylindrical surface defining a gradually decreasing diameter, a lower cylindrical surface having a diameter less than said upper cylindrical surface and a medial surface interposed between said upper and said lower cylindrical surfaces, and an outlet positioned proximate to said lower cylindrical surface, said cavity communicating with the circulation chamber via said outlet, wherein said first portion includes a frusto-conical projection and said second portion includes a frusto-conical recess, said frusto-conical projection receivable in said frusto-conical recess, and wherein said first portion comprises at least two segments

DETAILED DESCRIPTION OF ILLUSTRATIVE EMBODIMENTS

Figure 1:
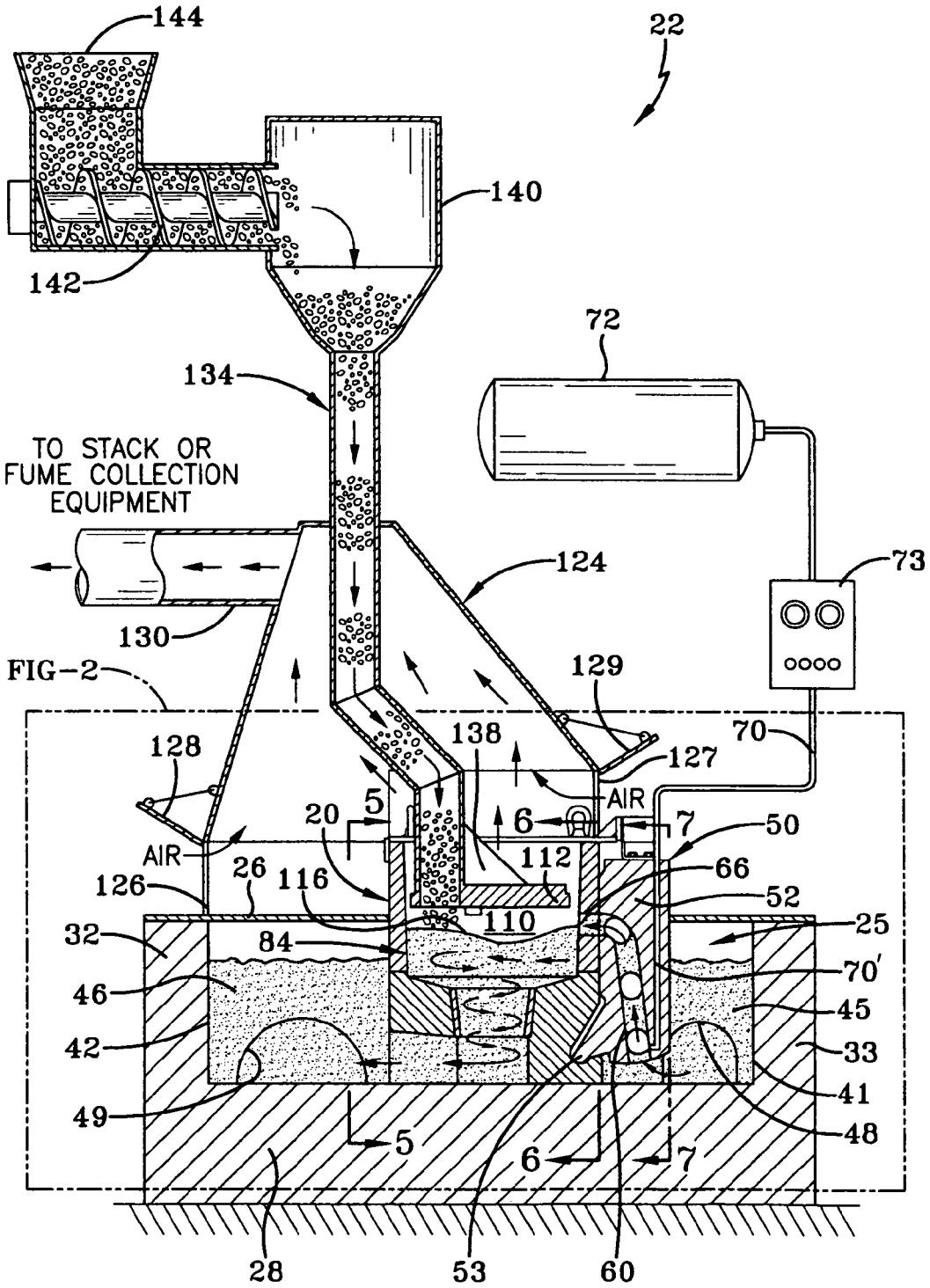
FIG. 1 is a cross-sectional view of a molten metal furnace including a segmented well block according to the present invention.
Figure 2:
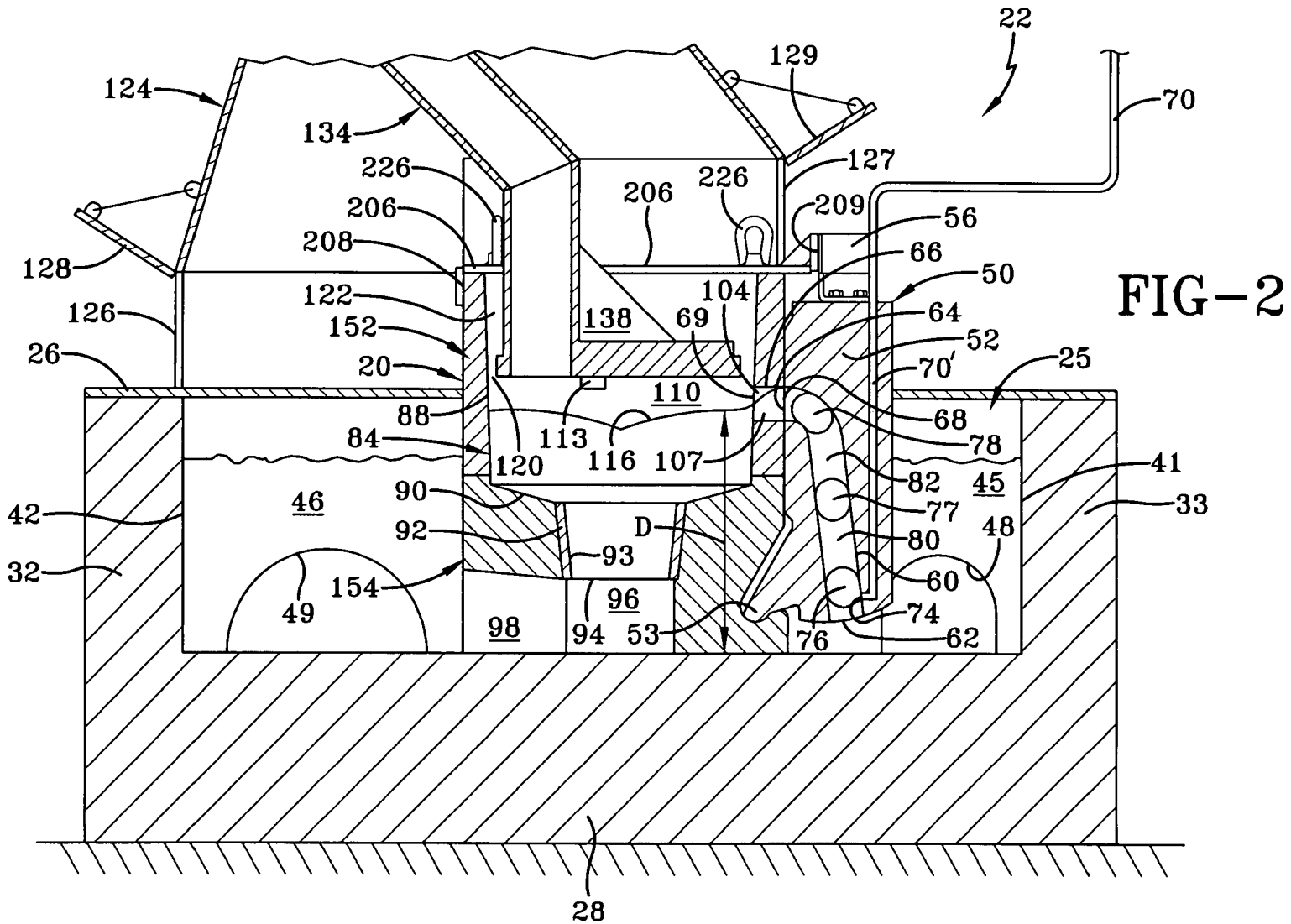
FIG. 2 is an enlarged cross-sectional view of the segmented well block and molten metal furnace of FIG. 1.
Figure 3:
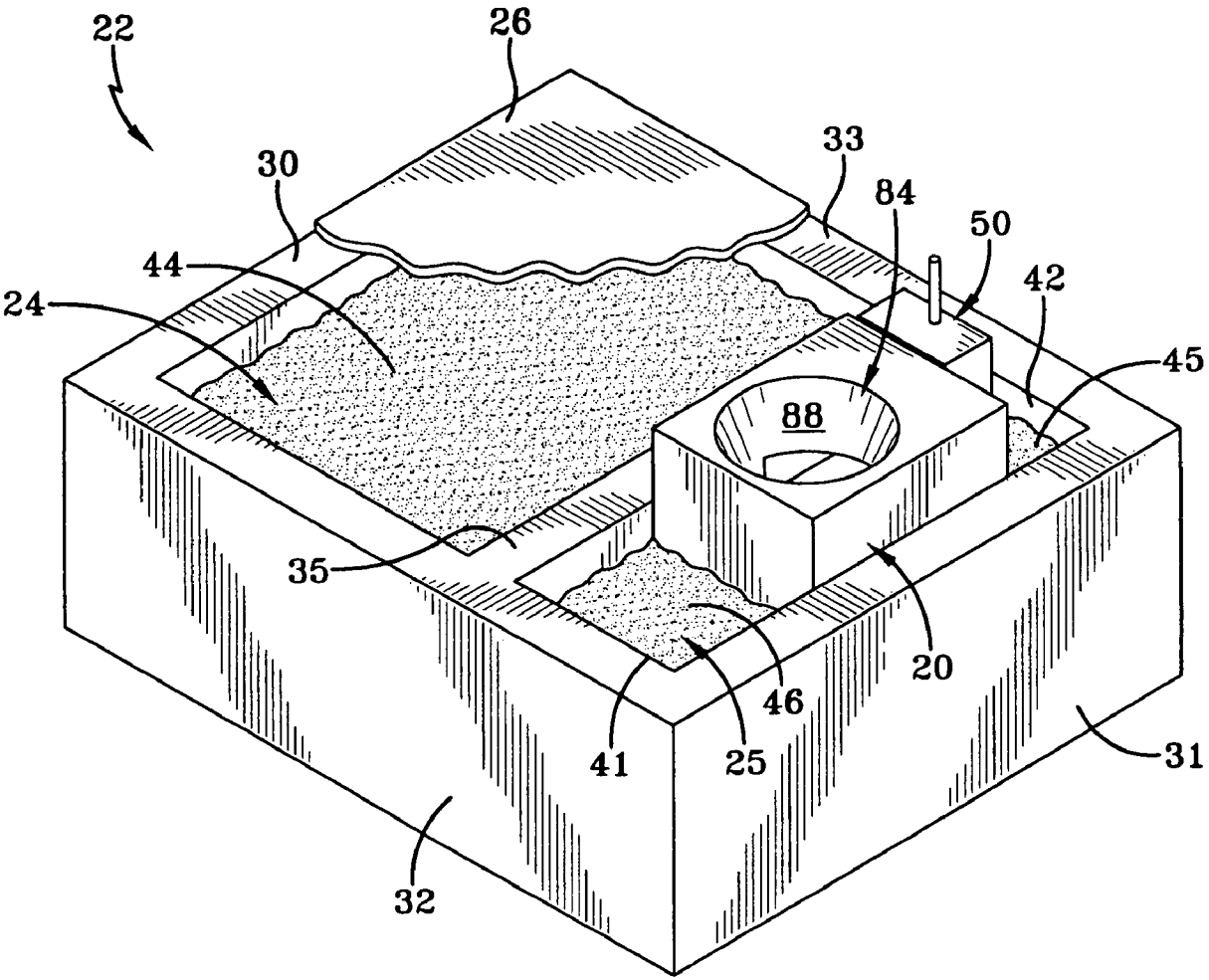
FIG. 3 is a schematic perspective view of the molten metal furnace showing a main chamber and a circulation chamber, where the segmented well block is positioned within the circulation chamber.
Figure 6:
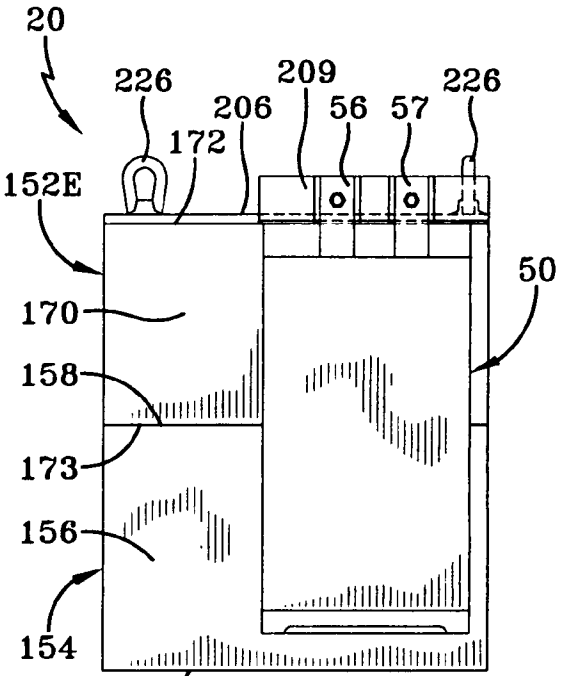
FIG. 6 is an elevational view of the segmented well block showing a molten metal pump attached thereto taken along line 7-7 of FIG. 1.

The well blocks of one or more embodiments of this invention can be described with reference to a molten metal furnace with which they may be used, although the invention described herein is not limited by the type of furnace. FIGS. 1-3 show a molten metal furnace 22 having a well block 20 positioned therein. Well block 20 can be fabricated by using the various refractory materials which are known in the art. In one embodiment of the present invention, the refractory materials disclosed in U.S. Pat. Nos. 5,888,292 and 6,447,596, which are incorporated herein by reference, can be used. Furthermore, as is known in the art, well blocks are used in conjunction with pumps, but the type and configuration of the pump employed does not limit practice of this invention.

Furnace 22 includes a bottom wall 28 (FIGS. 1 and 2), and four sidewalls 30, 31, 32, 33, and a transverse wall 35 (FIG. 3). Transverse wall 35 divides furnace 22 into a main chamber 24 and a circulation chamber 25. Well block 20 is positioned within circulation chamber 25.

As shown in FIGS. 1-3, main chamber 24 includes a cover 26, and circulation chamber 25 includes a first portion 41 and a second portion 42 delineated by well block 20, which is positioned therebetween. A molten metal bath 44 is provided in main chamber 24 and is connected to a first molten metal bath 45 and a second molten metal bath 46, which are provided in first portion 41 and second portion 42, respectively, of circulation chamber 25. This connection may occur, for example, via a first and a second communicating passageways 48 and 49, respectively. As shown in FIGS. 1 and 2, communicating passageways 48 and 49 allow the molten metal to circulate through well block 20 between molten metal baths 44, 45 and 46. In FIG. 1, the presence of molten metal is indicated by stippling, and flow of the molten metal through well block 20 between first and second molten metal baths 45 and 46 is indicated by various arrows. Although the level of the molten metal is indicated in FIG. 2, the stippling and arrows are not included for the sake of clarity.

Figure 5:
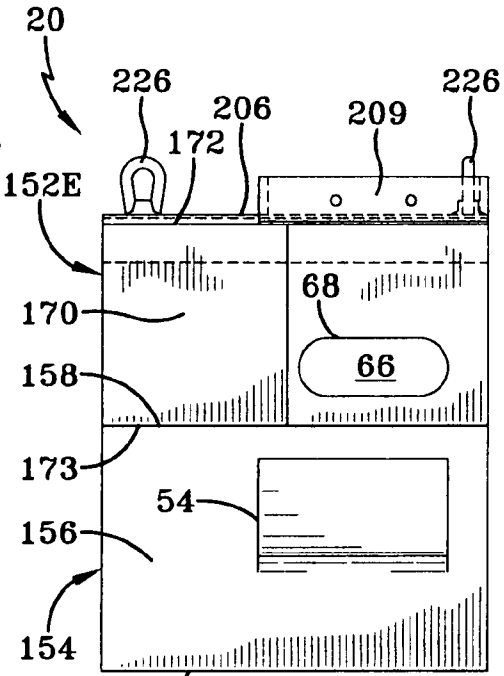
FIG. 5 is an elevational view of the segmented well block taken along Line 6-6 of FIG. 1.
Figure 4:
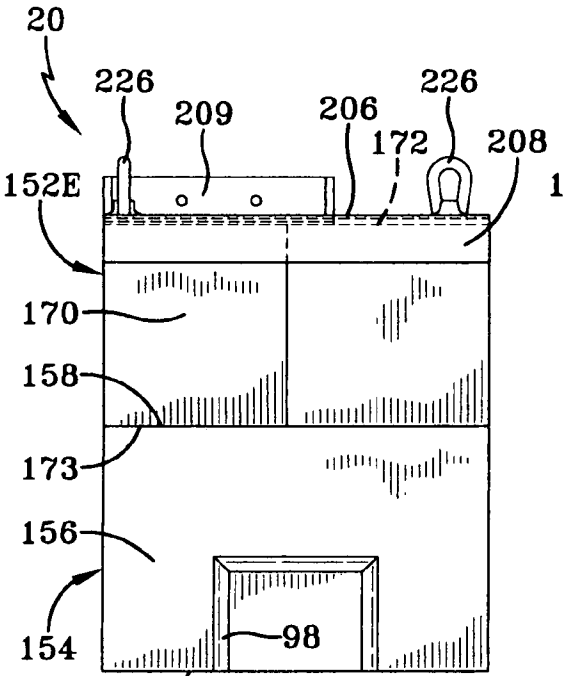
FIG. 4 is an elevational view of the segmented well block taken along Line 5-5 of FIG. 1.

Directly adjacent to and communicating with interior of well block 20 is a molten metal pump 50. Pump 50 includes a body 52 (sometimes called an end block) and a projection 53, which protrudes from body 52 and is adjacent to the lower extremity thereof. Projection 53 engages a recess 54 (FIG. 5) provided in well block 20 in order to support pump 50 on well block 20. As shown in FIG. 2, body 52 includes a tangentially oriented passageway 60, which extends between a lower opening 62 and an upper opening 64. Lower opening 62 communicates with first molten metal bath 45 (provided in first portion 41 of circulation chamber 25), and upper opening 64 communicates with a horizontal passageway 66 in well block 20, which has an inlet 68 (directly adjacent upper opening 64) and an outlet 69.

A blanket (not shown), which may be thermally stable and/or flame resistant (e.g., Zircon), may be provided between well block 20 and molten metal pump 50. The blanket is provided with hole (not shown) allowing upper opening 64 of tangentially oriented passageway 60 to communicate with inlet 68 of horizontal passageway 66. The blanket can repel molten metal, and ensure that the molten metal flows from tangentially oriented passageway 60 into horizontal passageway 66.

As shown in FIG. 1, an inert gas line 70 extends from a tank 72 (containing nitrogen ($N_2$), argon, or other inert gas) through controls 73 to molten metal pump 50. Inert gas line 70 is interconnected with an inert gas line 70' which extends through the body 52 of molten metal pump 50 to an inert gas outlet 74. Inert gas outlet 74 communicates with tangentially oriented passageway 60 adjacent to lower opening 62, and serves to inject nitrogen ($N_2$), argon, or other inert gas (flowing through inert gas lines 70 and 70') into tangentially oriented passageway 60.

During operation of molten metal pump 50, nitrogen ($N_2$), argon, or other inert gas flows into tangentially oriented passageway 60 through inert gas outlet 74. The force or energy associated with bubbles 76, 77, and 78 formed from the nitrogen ($N_2$), argon, or other inert gas exiting inert gas outlet 74 moves molten metal through tangentially oriented passageway 60 and horizontal passageway 66 into well block 20. That is, bubbles 76, 77, and 78 rise through tangentially passageway 60 to move or carry therewith molten metal at 80 and 82 from first molten metal bath 45 through horizontal passageway 66 into a vortex well 84 provided in the center of block 20.

Vortex well 84 can be used to mix scrap metal in the form of metal chips with the molten metal provided in furnace 22. Vortex well 84 is a central hollowed out portion of well block 20 which has an upper region 88, a medial region 90, and a lower region 92 with a surrounding liner 93. Upper region 88, as best shown in FIG. 2, is defined by a cylindrical and gradually narrowing surface (i.e., frustum), i.e., forms a frustum within block 20. Lower region 92 is defined by a cylindrical, gradually narrowing surface with a diameter less than that of the upper region 88. Medial region 90 is interposed between upper region 88 and lower region 92, and is defined by a surface with a diameter which transitions between the upper region 88 to the lower region 92. As shown in FIGS. 1 and 2, a lower outlet 94, which communicates with a bottom recess 96 in well block 20, is provided at the bottom of lower region 92. A horizontal passageway 98 extends from bottom recess 96 to second portion 42 of circulation chamber 25. As such, molten metal pumped into vortex well 84 (by molten metal pump 50) empties into second molten metal bath 46 (provided in second portion 42 of circulation chamber 25) via bottom recess 96 and horizontal passageway 98.

In one embodiment of the present invention, as shown in FIGS. 1 and 2, horizontal passageway 66 enters vortex well 84 at a point where at least part of outlet 69 lies or is positioned above a level D. Level D signifies a maximum level of the molten metal inside vortex well 84. Different size molten metal furnaces will be adapted to hold different maximum amounts of molten metal in vortex well 84. Those different maximum amounts of molten metal will each rise to a different maximum level D for each size of molten metal furnace as appreciated by those skilled in the art.

As shown in FIGS. 1 and 2, horizontal passageway 66 is configured so that molten metal from pump 50 enters vortex well 84 at a point where at least fifty percent of outlet 69 lies above maximum level D. By assuring that outlet 69 is positioned at least fifty percent above maximum level D, the back pressure exerted by the molten metal in tangentially oriented passageway 60 horizontal passageway 66 is substantially reduced. The reduction in the back pressure allows metal masses 80 and 82 to move more easily through tangentially oriented passageway 60 and horizontal passageway 66, thereby increasing the efficiency of molten metal pump 50.

Furthermore, as molten metal begins flowing into vortex well 84, a gap 104 forms in horizontal passageway 66 due to the position of outlet 69 with respect to maximum level D. Gap 104 is formed between the upper extremity of horizontal passageway 66 and a molten metal mass 107 (flowing out of horizontal passageway 66). As such, bubbles 76, 77, and 78 moving through tangentially oriented passageway 60 and horizontal passageway 66 are ultimately released into gap 104, and splashing or sputtering of molten metal mass 107 as it exits horizontal passageway 66 is substantially reduced. This particular configuration is disclosed in U.S. Application No. 2003/0197313 A1, which is incorporated herein by reference.

The nitrogen ($N_2$), argon, or other inert gas entering well block 20 through tangentially oriented passageway 60 and horizontal passageway 66 becomes part of a gas blanket 110. During operation of molten metal pump 50, gas blanket 110 can be continuously or intermittently replenished with the nitrogen ($N_2$), argon, or other inert gas from bubbles 76, 76, and 78 flowing through tangentially oriented passageway 60 and horizontal passageway 60. Besides reducing splashing or sputtering of molten metal mass 107, the location of horizontal passageway 66 with respect to the maximum level D also allows the nitrogen ($N_2$), argon, or other inert gas to be directly released into gas blanket 110.

A refractory cover 112 is optionally positioned above vortex well 84 and gas blanket 110. Refractory cover 112 is equipped with a sensor 113 that overlies the molten metal provided in vortex well 84. Sensor 113 senses surface level 116 of the molten metal provided in vortex well 84 to prevent overfilling of molten metal furnace 22.

Between refractory cover 112 and well block 20 there is a peripheral space 120. Peripheral space 120 allows for the formation of a combustion zone 122 for permitting oils, paints, lacquers as well as other volatile hydrocarbons to exit from below refractory cover 112 and be burned off. Peripheral space 120 will also allow the escape of the nitrogen ($N_2$), argon, or other inert gas (forming gas blanket 110) as additional gasses are added from molten metal pump 50. Useful refractory covers and configurations are known as disclosed in U.S. Application No. 2003/0047850 A1, which is incorporated herein by reference.

Refractory cover 112 may be adjustable in height, but normally provides several inches of clearance above surface level 116 of the molten metal provided in vortex well 84. As shown in FIGS. 1 and 2, a smoke collection hood 124, which includes air intakes 126 and 127 having respective closure doors 128 and 129, is provided above combustion zone 122. A line or conduit 130 leads to a stack or particle collection equipment (not shown) from smoke collection hood 124. A scrap feed tube 134 (in which the above-discussed metal chips 136 are fed into vortex well 84) through smoke collection hood 124. Scrap feed tube 134 is preferably attached to refractory cover 112 by means of a flange 138. At its upper end, scrap feed tube 134 receives metal chips from a hopper 140 fed by a screw conveyor 142 that receives metal chips 136 at a feed opening 144.

Well block 20 of the present invention is advantageously segmented. In other words, well block 20 includes at least two portions that are ultimately mated with one another. An advantage of this configuration is the ability to replace only a portion or portions that may be cracked or otherwise damaged. For example, as shown in FIG. 2, well block is segmented into an upper first portion 152 and lower second portion 154.

Figure 9:
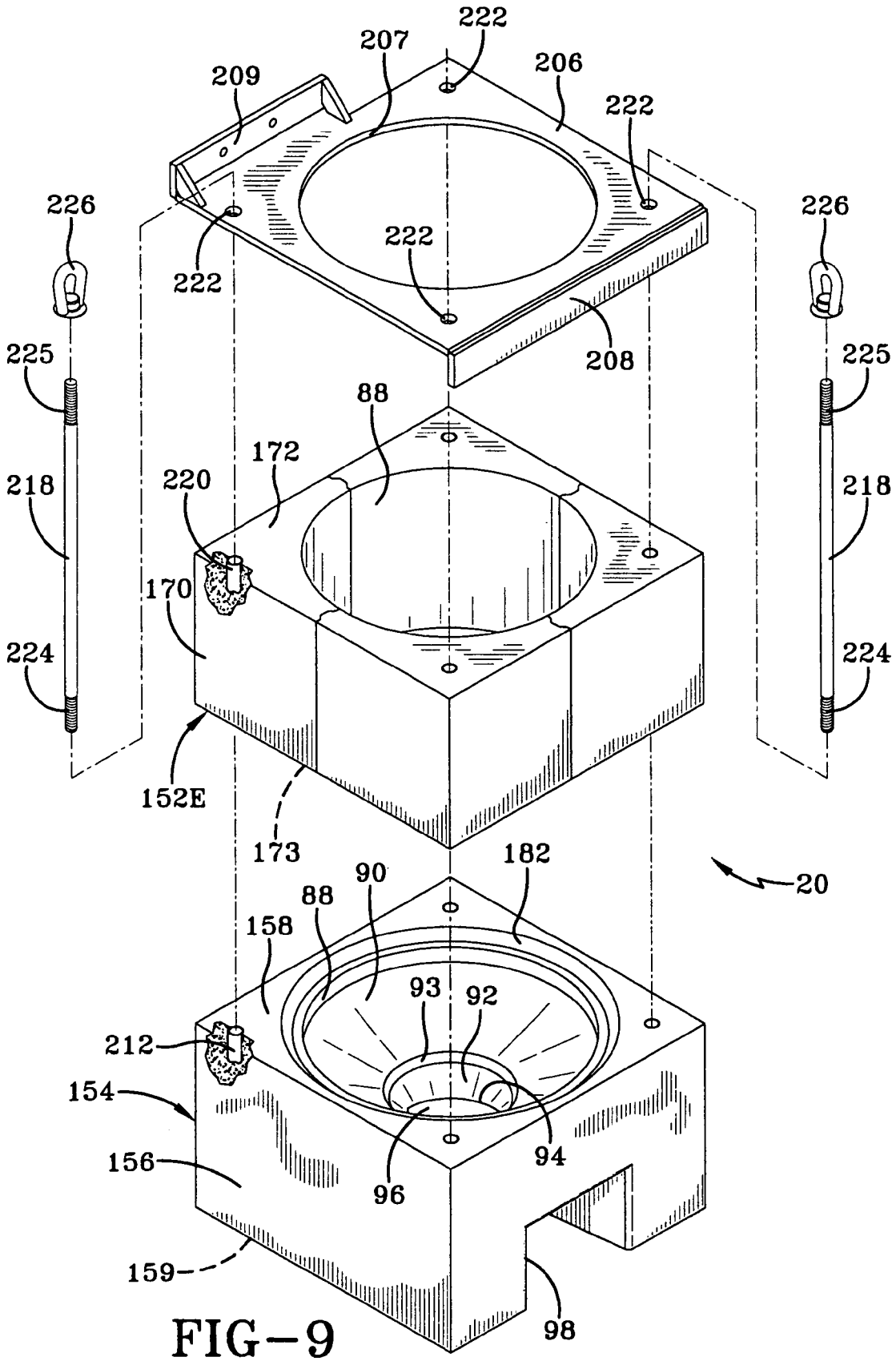
FIG. 9 is an exploded perspective view of the segmented well block showing the upper first portion of FIGS. 7 and 8, and a lower second portion.
Figure 10:
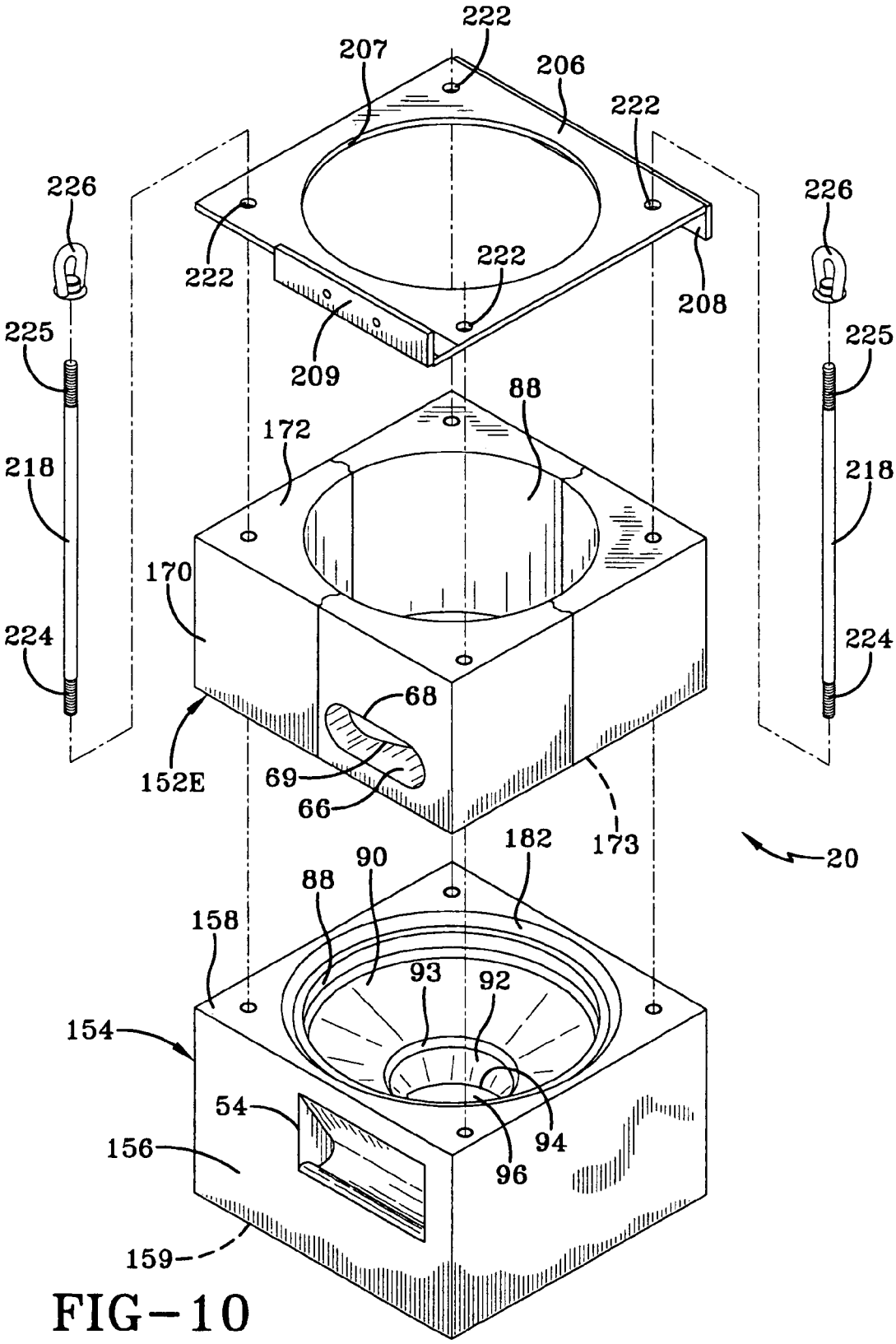
FIG. 10 is another exploded perspective view of the segmented well block showing the upper first portion of FIGS. 7 and 8, and the lower second portion.

As shown in FIGS. 9 and 10, lower second portion 154 includes a portion of vortex well 84, and serves as a base (or pedestal) on which upper first portion 152 is positioned. Lower second portion 154 includes a body 156 with a top surface 158 and a bottom surface 159. The portion of vortex well 84 formed in lower second portion 154 extends downwardly through body 156 from top surface 158. As shown in FIGS. 9 and 10, lower second portion 154 includes the extreme lower portion of upper region 88, medial region 90, and lower region 92 of vortex well 84. As discussed above, vortex well 84 communicates via lower outlet 94 with bottom recess 96 and horizontal passageway 98, which are also formed in lower second portion 154. As discussed above, bottom recess 96 and horizontal passageway 98 allow molten metal from vortex well 84 to empty into second portion 42 of circulation chamber 25.

As shown in FIG. 10, lower second portion 154 also includes recess 54 for receiving projection 53 of pump 50. As such, recess 54 serves to support pump 50 so that it can be positioned to align upper opening 64 of tangentially oriented passageway 60 with horizontal passageway 66 (provided through upper first portion 152).

Figure 7:
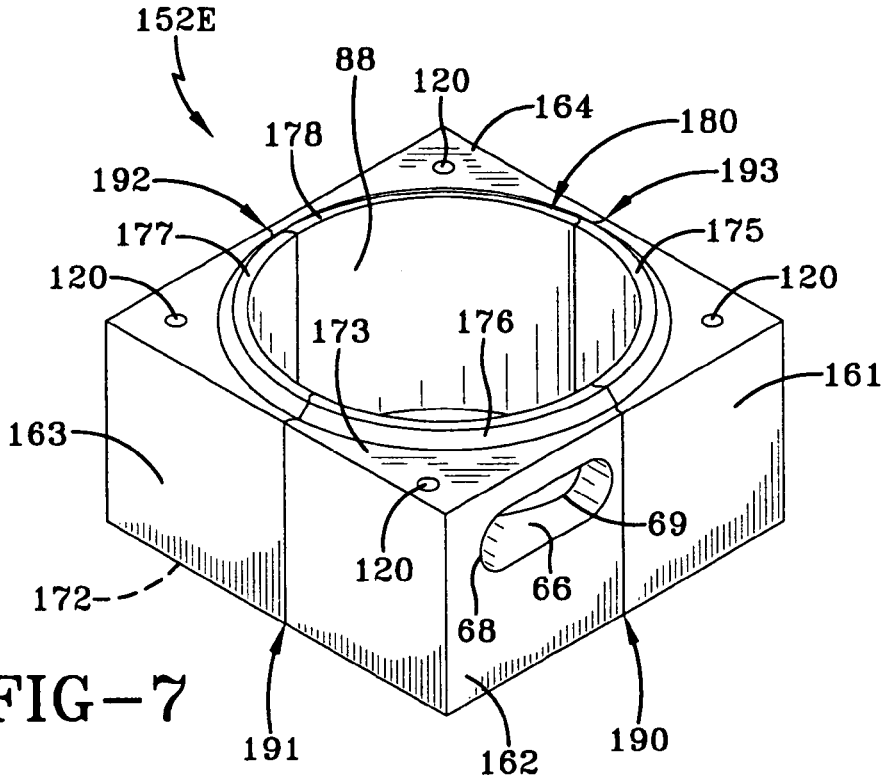
FIG. 7 is a bottom perspective view of an assembled upper first portion of the segmented well block.
Figure 8:
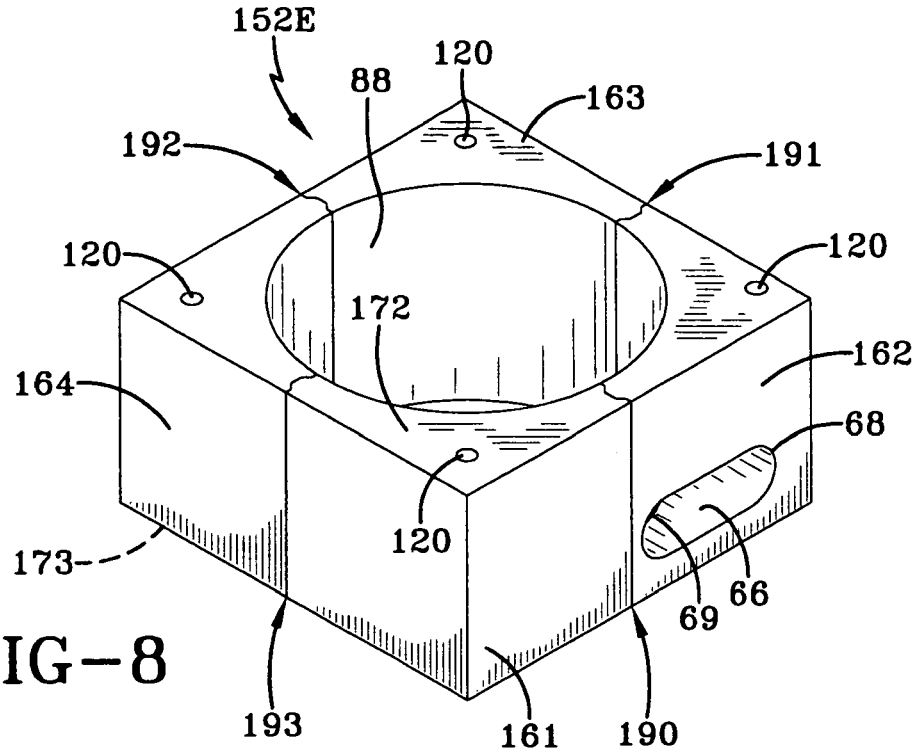
FIG. 8 is a top perspective view of the assembled upper first portion of FIG. 7.
Figure 9A:
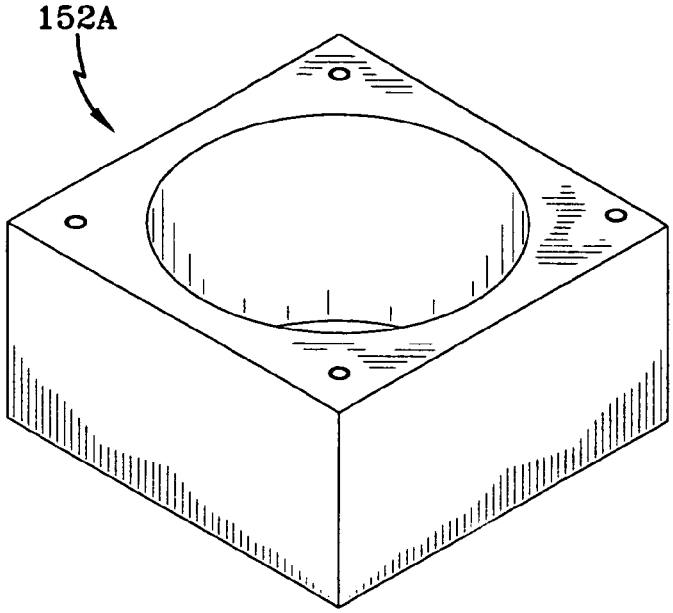
FIG. 9A is a perspective view of an upper first portion composed of one segment.
Figure 9B:
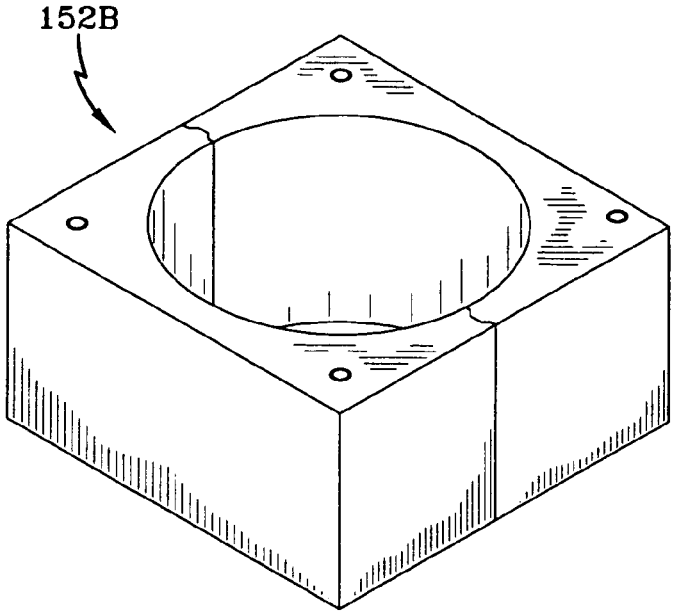
FIG. 9B is a perspective view of an upper first portion composed of two segments.
Figure 9C:
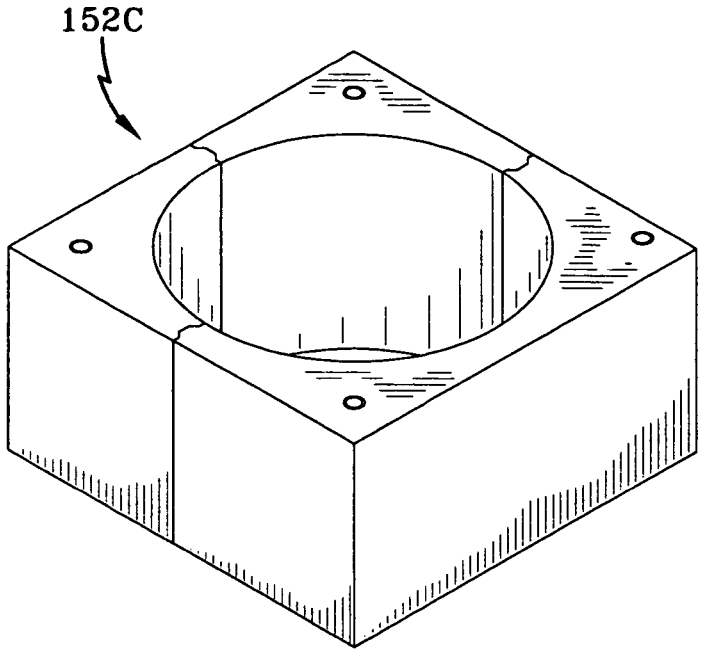
FIG. 9C is a perspective view of an upper first portion composed of three segments.
Figure 9D:
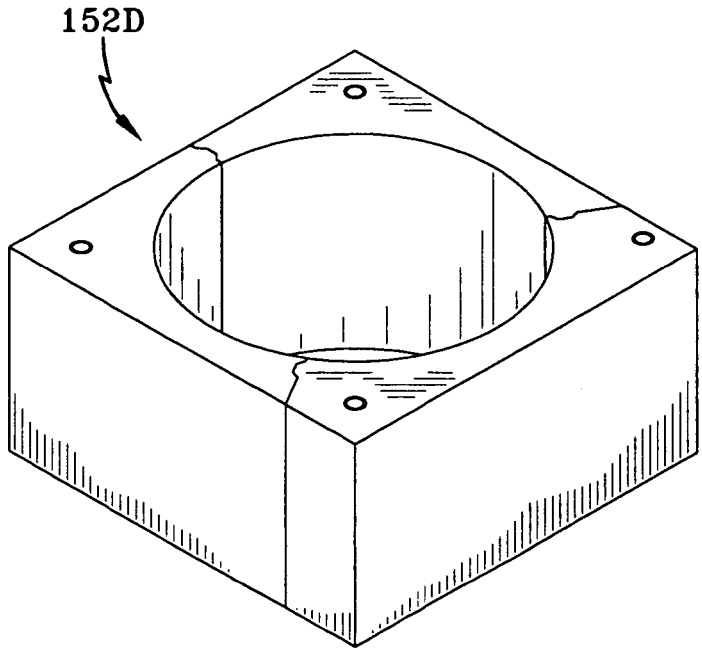
FIG. 9D is a perspective view of another upper first portion composed of three segments.

As shown in FIGS. 4-16, upper first portion 152 can be further portioned or segmented into a plurality of segments. Again, an advantage of this configuration is the ability to replace only a segment or segments that may be cracked or otherwise damaged. Various characters (A, B, C, D, and E) will be used to denote different upper first portions 152 having different numbers of segments. For example, upper first portion 152A, as depicted in FIG. 9A is undivided, and is formed as one (1) segment. Upper first portion 152B is depicted in FIG. 9B, and is formed from two (2) segments. Upper first portions 152C and 152D are depicted in FIGS. 9C and 9D, respectively, and, although possess different shapes and sizes, are each formed from three (3) segments. Furthermore, upper first portion 152E, as shown in FIGS. 4-9, and 10-13 is formed from four (4) segments. As those skilled in the art will appreciate, upper first portion 152 can be further segmented and/or be symmetrically or asymmetrically divided to form segments having different shapes and sizes.

For exemplary purposes, upper first portion 152E (depicted in FIGS. 4-9, and 10-13) will be used to illustrate features that can be common to each of the segmented upper first portions. The upper first portion 152E includes four (4) segments 161, 162, 163, and 164 each having the same shape and size. As shown in FIGS. 7 and 8, the segments 161, 162, 163, and 164 are effectively formed as one quarter of the upper first portion 152E. However, segments 161, 162, 163, and 164 could have different shapes and sizes provided they can be assembled to form upper first portion 152E.

When assembled (FIGS. 7 and 8), upper first portion 152E includes a body 170 with a top surface 172 and a bottom surface 173. As shown in FIGS. 7, 9, 9 and 10, a majority of upper portion 88 of vortex well 84 extends between top surface 172 and bottom surface 173. Upper first portion 152E also includes horizontal passageway 66 (having inlet 68 and outlet 69), which extends through body 170 to connect molten metal pump 50 with vortex well 84.

Figure 7A:
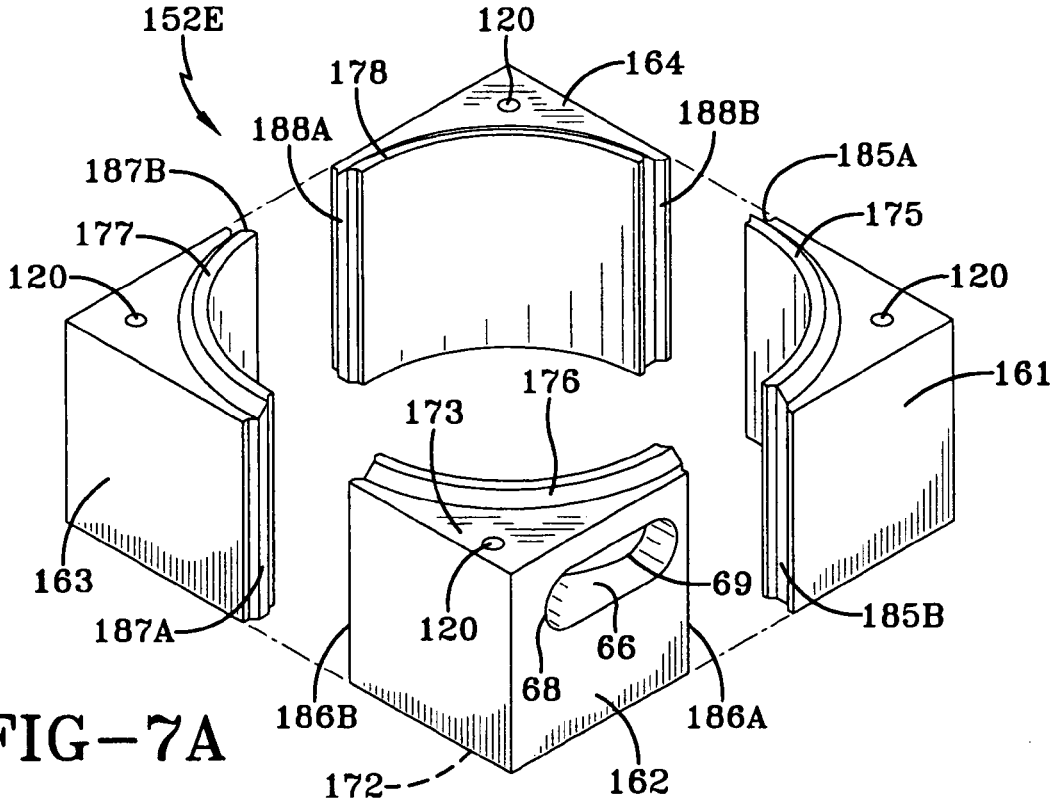
FIG. 7A is an exploded perspective view of the upper first portion depicted in FIG. 7.

As shown in FIGS. 7 and 7A, segments 161, 162, 163, and 164 include frusto-conical segments 175, 176, 177, and 178, respectively. When the upper first portion 152E is assembled, frusto-conical segments 175, 176, 177, and 178 form frusto-conical projection 180 (FIG. 7) projecting outwardly from bottom surface 173. The frusto-conical projection 180 together with a frusto-conical recess 182 (formed along top surface 158 of lower second portion 154 as shown in FIGS. 9 and 10) aid in the assembly of upper first portion 152E and lower second portion 154. That is, frusto-conical projection 180 and frusto-conical recess 182 are provided to matingly engage one another to aid in the proper positioning of upper first portion 152E and lower second portion 154 with respect to one another.

Moreover, the frusto-conical segments 175, 176, 177, and 178 aid in the proper positioning of the segments 161, 162, 163, and 164 with respect to one another. For example, when segments 161, 162, 163, and 164 are positioned atop lower second portion 154, and the frusto-conical segments 175, 176, 177, and 178 contact the frusto-conical recess 182, gravity forces segments 161, 162, 163, and 164 to slide on the downwardly inclined shape of the frusto-conical recess 182, and, in doing so, forces segments 161, 162, 163, and 164 together.

Figure 8A:
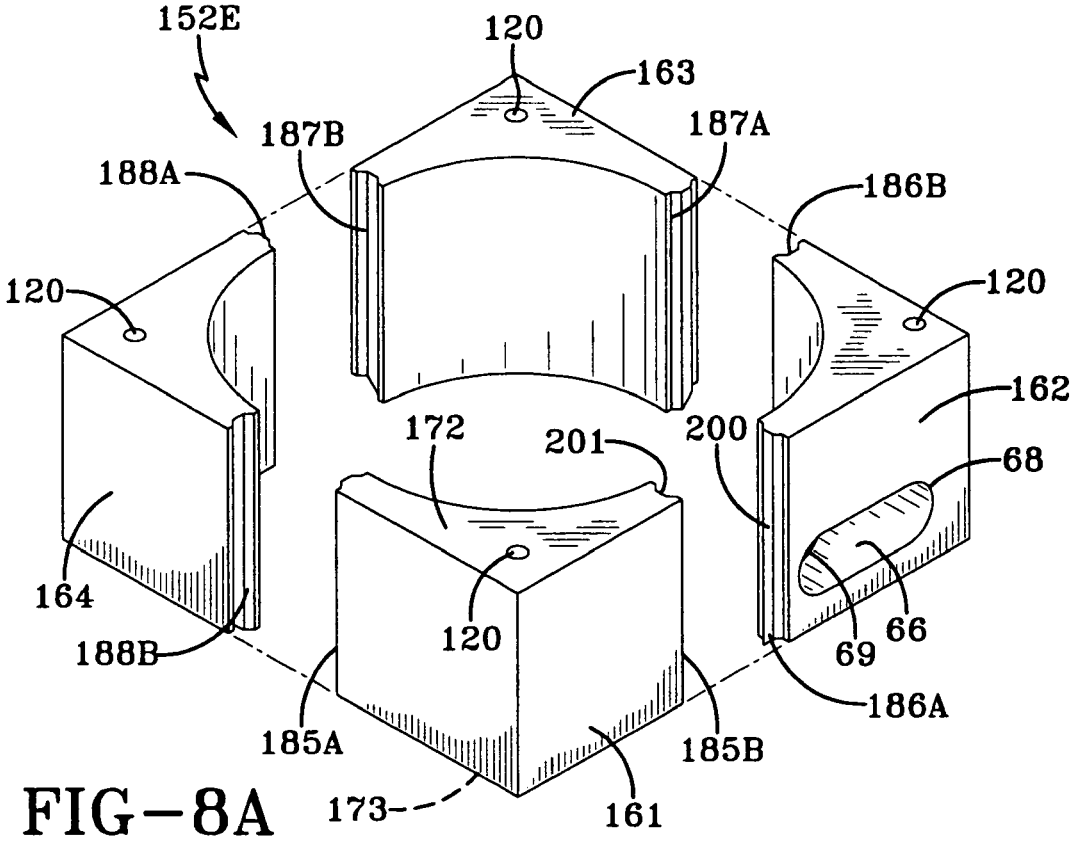
FIG. 8A is an exploded perspective view of the upper first portion depicted in FIG. 8.

When frusto-conical segments 175, 176, 177, and 178 are inserted into lower second portion 154 to interface with frusto-conical recess 182, the adjacent sidewalls of segments 161, 162, 163, and 164 are compelled to interface with one another. For example, segment 161 includes sidewalls 185A and 185B, segment 162 includes sidewalls 186A and 186B, segment 163 includes sidewalls 187A and 187B, and segment 164 includes sidewalls 188A and 188B. To illustrate the interface of the sidewalls, reference is made to FIGS. 7A and 8A showing sidewall 185B of segment 161 and sidewall 186A of segment 162 positioned proximate one another, and ultimately interfacing at an interface 190 (FIGS. 7 and 8), when segmented well block 20 is assembled.

To enhance the interfaces of the sidewalls as indicated in FIGS. 7 and 8 by the numerals 190, 191, 192, and 193, the sidewalls can be specially configured. For example, sidewalls 185A, 186A, 187A, and 188A can be provided with protruding faces 200 (FIG. 8A) and sidewalls 185B, 186B, 187B, and 188B can be provided with receiving faces 201 (FIG. 8A). Protruding faces 200 are projections that are configured to fit in notches that form receiving faces 201. As such, when segments 161, 162, 163, and 164 are positioned atop lower second portion 154, and frusto-conical projection 180 (formed by frusto-conical segments 175, 176, 177, and 178) is received within frusto-conical recess 182, protruding faces 200 and receiving faces 201 interface with one another to ensure that segments 161, 162, 163, and 164 are properly positioned with respect to one another.

An interlocking system 204 (FIGS. 11, 12, and 15) is provided to maintain the integrity of the interface between upper first portion 152E and lower second portion 154. Interlocking system 204 employs a plate 206 sized to approximate the perimeter dimensions of top surface 172 of upper portion 152E. Plate 206 can be ultimately positioned atop top surface 172, and includes a center aperture 207 which provides access to vortex well 84. Plate 206 is used by interlocking system 204 in clamping upper first portion 152E and lower second portion 154 together to secure molten metal pump 50 in an upright position.

Plate 206 includes a downturned lip 208 and an upturned lip 209. Downturned lip 208 is provided to interface with a side surface of upper first portion 152E to properly locate center aperture 207 relative upper portion 88 of vortex well 84. In locating center aperture 207, downturned lip 208 also positions upturned lip 209 adjacent molten metal pump 50.

Upturned lip 209 serves as a bracket for attaching stanchions 56 and 57 (FIGS. 2 and 6) of molten metal pump 50 to plate 206. As discussed above, molten metal pump 50 can be supported by recess 54 provided in lower second portion 154. Therefore, stanchions 56 and 57 can be mechanically (or otherwise) fastened to upturned lip 209 to secure molten metal pump 50 in an upright position. The support of the molten metal pump 50 using recess 54, and the attachment of stanchions 56 and 57 to upturned lip 209 positions molten metal pump 50 such that upper opening 64 (of tangentially oriented passageway 60) can be can be positioned directly adjacent inlet 68 of horizontal passageway 66 leading into the vortex well 84.

Figure 12:
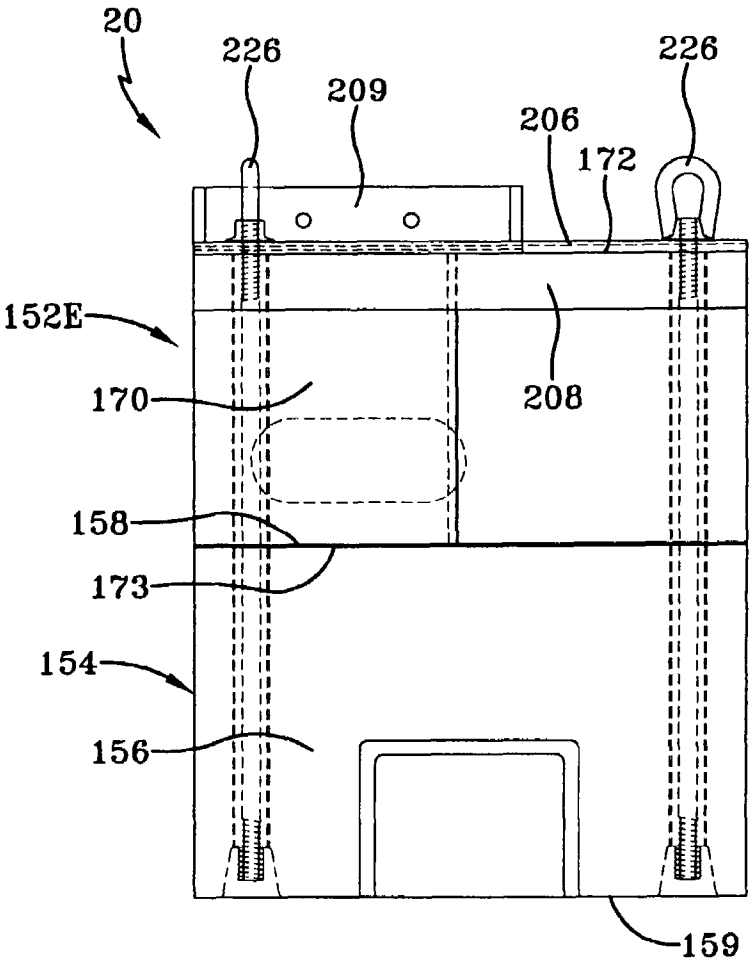
FIG. 12 is an elevational view of the segmented well block of FIG. 11.
Figure 11:
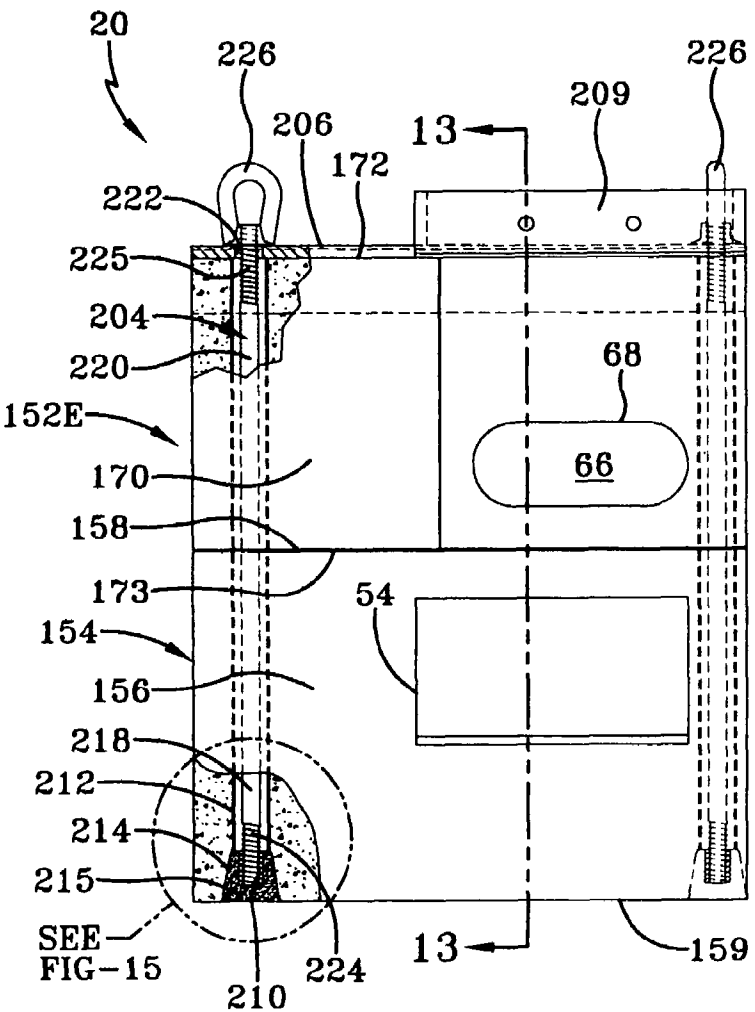
FIG. 11 is a partially fragmented elevational view of the segmented well block of FIGS. 9 and 10 showing an interlocking system.
Figure 15:
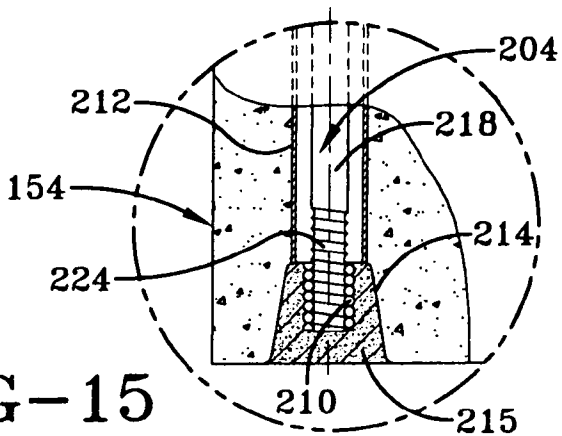
FIG. 15 is an enlarged view of FIG. 11 showing a portion of the interlocking system.

In addition to the plate 206, interlocking system 204 may include coil-wire anchors 210 and cylindrical tubes 212 positioned within lower second portion 154 along the perimeter thereof. Coil-wire anchors 210 and cylindrical tubes 212, as shown in FIGS. 11 and 12, can be positioned adjacent the corners of lower second portion 154. To that end, when lower second portion 154 is initially cast, the cylindrical tubes 212 (which can be formed from Mullite to endure the firing process) are cast in position, and frusto-conical recesses 214 are formed therein. After casting of lower second portion 154 is complete, coil-wire anchors 210, as shown in FIGS. 11 and 15, are positioned adjacent cylindrical tubes 212 in frusto-conical recesses 214. Thereafter, frusto-conical recesses 214 can be filled with filler materials 215, which may be similar, if not identical, to the refractory materials used in forming the remainder of well block 20. Filler materials 215 can be cured to cement coil-wire anchors 210 in position adjacent the cylindrical tubes 212.

Coil-wire anchors 210 serve as threaded apertures for receiving threaded studs 218. Threaded studs 218 are used by interlocking system 204 to draw upper first portion 152E and lower second portion 154 together. For example, as shown in FIGS. 11 and 12, cylindrical tubes 220 (which, like the cylindrical tubes 212 can be formed from Mullite to endure the firing process) are cast in position in segments 161, 162, 163, and 164. When segments 161, 162, 163, and 164 are assembled, cylindrical tubes 220 are positioned adjacent the corners of the upper first portion 152E. Cylindrical tubes 212 and 220 are advantageously aligned when well block 20 is assembled, and apertures 222 (also aligned with cylindrical tubes 212 and 220) are provided adjacent the corners of plate 206. The alignment of apertures 222 and cylindrical tubes 212 and 220 allows threaded studs 218 to be inserted therethrough.

As shown in FIGS. 11 and 12, the threaded studs 218 can be inserted through apertures 222 and into cylindrical tubes 212 and 220. The threaded studs 218 include first threaded ends 224 and second threaded ends 225. First threaded ends 224 are screwed into coil-wire anchors 210 (FIG. 15) and second threaded ends 225 (which are adapted to extend beyond plate 206 when first threaded ends 224 are screwed into position) are adapted to receive nuts.

Figure 13:
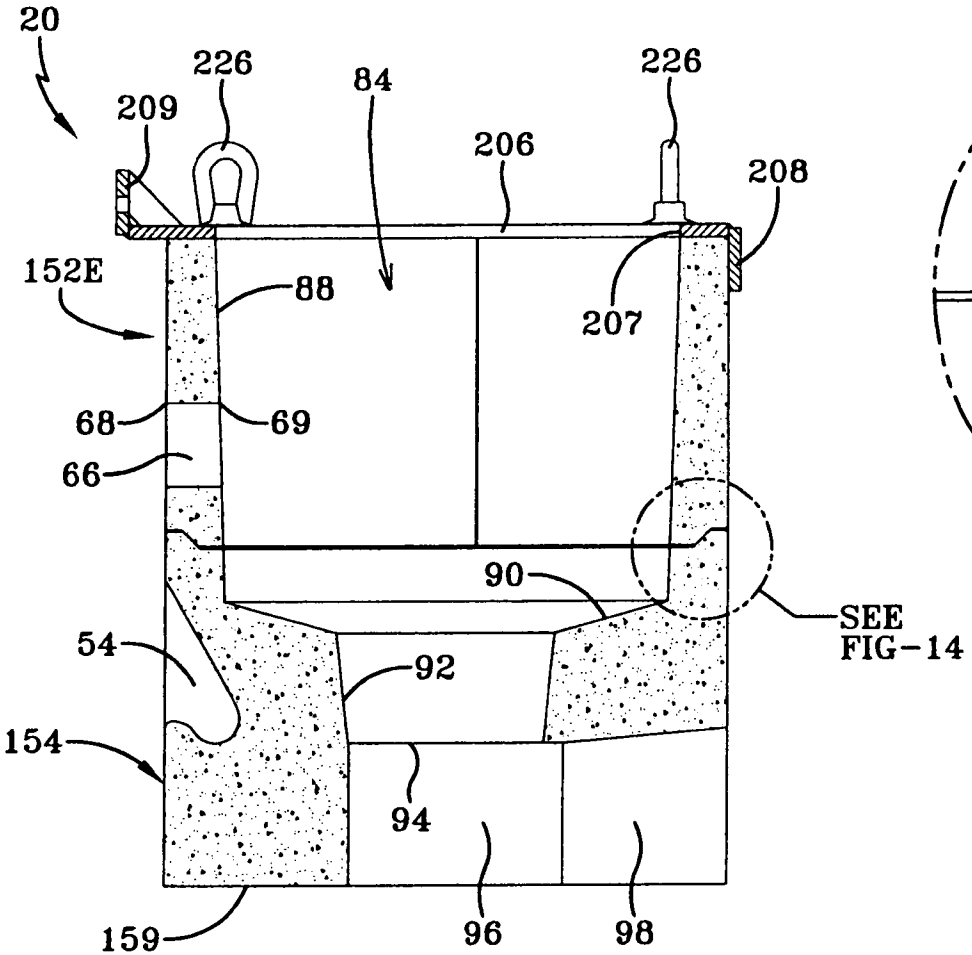
FIG. 13 is an cross-sectional view of the segmented well block of FIG. 11.

As shown in FIGS. 11-13, eye-nuts 226 are screwed onto second threaded ends 225 of threaded studs 218. As eye-nuts 226 are tightened against plate 206, upper first portion 152E and lower second portion 154 are forced together. As such, interlocking system 204 serves as a vice, wherein tightening of eye-nuts 226 clamps upper first portion 152E between plate 206 and lower second portion 154. Consequently, interlocking system 204 serves to effectively lock upper first portion 152E and lower second portion 154 into position with respect to one another.

Figure 14:
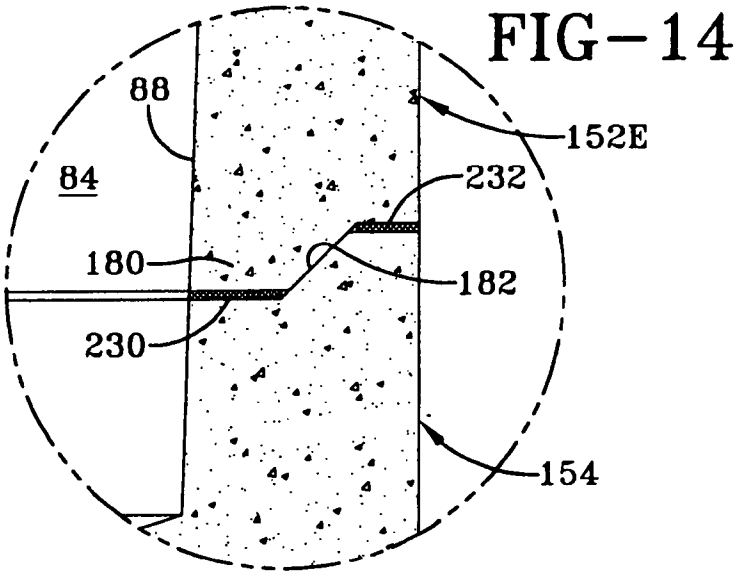
FIG. 14 is an enlarged view of FIG. 13 showing a sealing configuration.

To prevent molten metal from escaping vortex well 94, the interaction between upper first portion 152E and lower second portion 154 can be enhanced using circular bands of blanket material. For example, as seen in FIG. 14, a first circular band 230 is provided between frusto-conical projection 180 and frusto-conical recess 182, and a second circular band 232 is provided between bottom surface 173 (of upper first portion 152E) and top surface 158 (of lower second portion 154). First and second circular bands 230 and 232 are maintained in position through operation of interlocking system 204, and serve to prevent molten metal from escaping vortex well 84 from between upper first portion 152E and lower second portion 154. First and second circular bands 230 and 232 can be composed of the mineral Zircon which advantageously repels molten metal.

Figure 16:
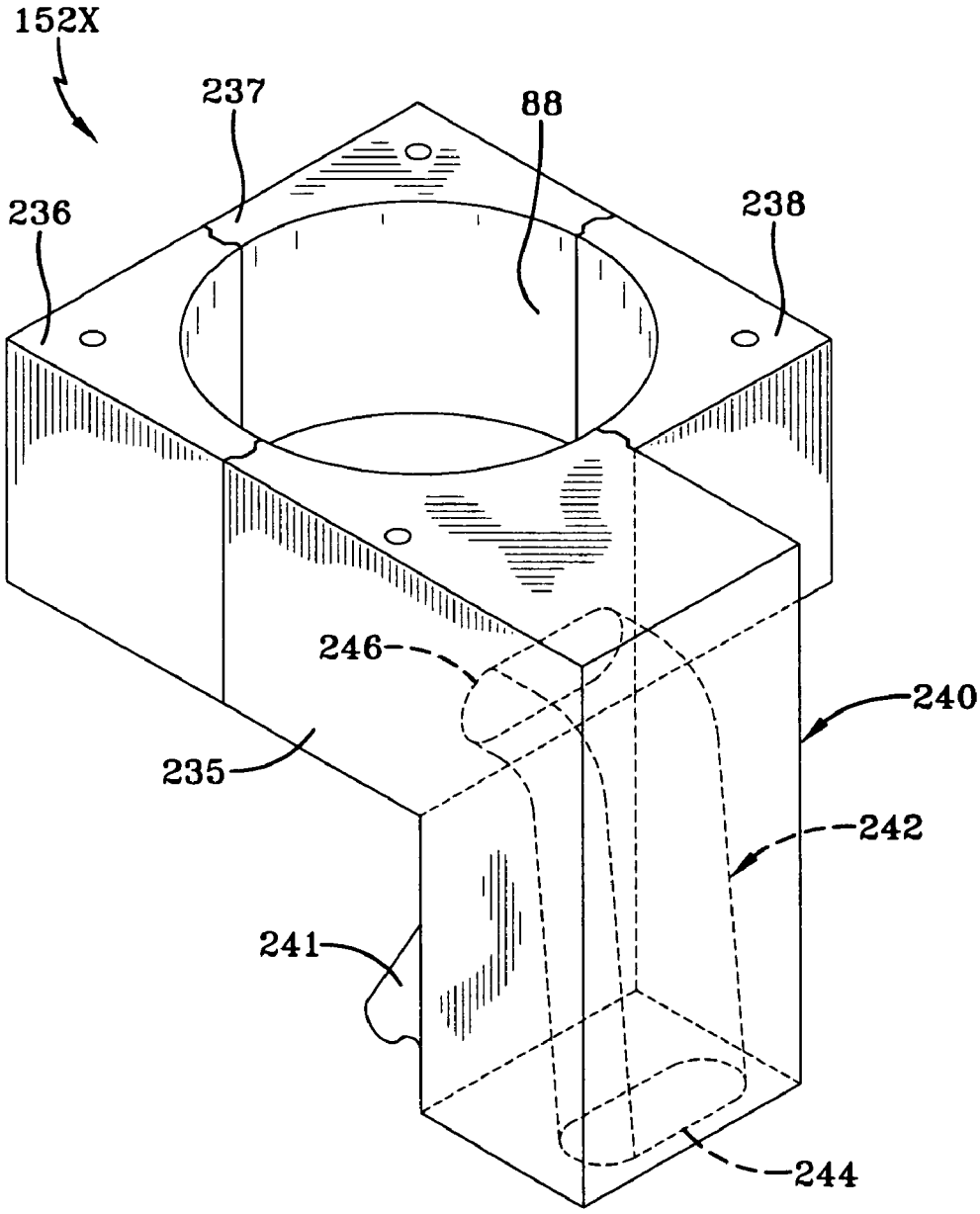
FIG. 16 is a perspective view of a well block including an upper first portion formed from four segments, where one of the four segments includes an integral molten metal pump.

In addition, an upper first portion 152X can be provided which integrally incorporates a molten metal pump. While upper first portion 152X is formed from four segments 235, 236, 237, and 238, and can include many of the features of upper first portion 152E, segment 235 integrally incorporates a molten metal pump portion 240. Segment 235 is partially supported by a projection 241, which, like projection 53 of molten metal pump 50, engages a recess (not shown) provided in lower second portion 154. Segment 235 includes a passageway 242, which effectively combines tangentially oriented passageway 60 (of molten metal pump 50) and horizontal passageway 66, as described above. Passageway 242 includes an inlet 244 for receiving molten metal, and an outlet 246. The outlet 246, as shown in FIG. 16, communicates with upper portion 88 of vortex well 84.

Segment 235 integrally incorporating molten metal pump portion 240 operates similarly to molten metal pump 50. An inert gas line (not shown) communicates with passageway 242 adjacent to inlet 244, and serves to inject nitrogen ($N_2$), argon, or other insert gas into passageway 242. The force or energy associated with bubbles formed from the nitrogen ($N_2$), argon, or other insert gas exiting the inert gas line moves molten metal through passageway 242 into upper first portion of vortex well 84. As such, when well block 20 incorporating upper first portion 152X is positioned within circulation chamber 25, molten metal can be transferred from first molten metal bath 45 to vortex well 84.

Various modifications and alterations that do not depart from the scope and spirit of this invention will become apparent to those skilled in the art. This invention is not to be duly limited to the illustrative embodiments set forth herein.

What is claimed is:

1. A segmented well block for use within a circulation chamber of a molten metal furnace comprising a first portion and a second portion, wherein said first portion is positioned atop said second portion, said first and second portions defining a cavity which includes an upper cylindrical surface defining a gradually decreasing diameter, a lower cylindrical surface having a diameter less than said upper cylindrical surface and a medial surface interposed between said upper and said lower cylindrical surfaces, and an outlet positioned proximate to said lower cylindrical surface, said cavity communicating with the circulation chamber via said outlet, wherein said first portion includes a frusto-conical projection and said second portion includes a frusto-conical recess, said frusto-conical projection receivable in said frusto-conical recess, and wherein said first portion comprises at least two segments.

2. A well block according to claim 1, wherein each of said at least two segments of said upper first portion include a first interfacing side wall and a second interfacing side wall.

3. A well block according to claim 2, wherein each said first interfacing sidewall includes a protruding face and each said second interfacing sidewall includes a receiving face, said protruding face includes a projection and said receiving face including a notch, said projection is receivable in said notch.

4. A well block according to claim 1, further comprises a stud, and wherein said first portion and said second portion include a cylindrical tube formed therein, said cylindrical tube in said first portion and said cylindrical tube in said second portion being axially aligned and adapted to receive said stud therethrough.

5. A well block according to claim 4, wherein said stud includes a threaded portion on the axial ends thereof.

6. A well block according to claim 5, further comprising a plate positioned atop said first portion having an aperture, an anchor provided in said second portion, and a nut, said anchor adapted to receive said threaded portion of said stud and said nut adapted to receive the opposed threaded portion, wherein said nut is positioned atop said plate, thereby clamping said first portion between said plate and said second portion.

7. A segmented well block according to claim 1, wherein said frusto-conical projection comprises at least two segments, said at least two frusto-conical segments slidably received on said frusto-conical recess to urge said at least two segments of said first portion together, and including first interfacing side walls and second interfacing side walls, said first interfacing side walls.

8. A segmented well block according to claim 7, wherein each said first interfacing sidewall includes a protrusion and said second interfacing sidewall includes a notch, said protrusion receivable in said notch.

9. A segmented well block according to claim 1, wherein said lower outlet of said cavity is connected with a bottom recess to empty molten received in said vortex well through a horizontal passageway into the circulation chamber.

10. A segmented well block according to claim 1, wherein one of said at least two segments of said first portion integrally incorporates a molten metal pump.

* * * * *